United States Patent [19]

King et al.

[11] Patent Number: 4,679,951

[45] Date of Patent: Jul. 14, 1987

[54] ELECTRONIC KEYBOARD SYSTEM AND METHOD FOR REPRODUCING SELECTED SYMBOLIC LANGUAGE CHARACTERS

[75] Inventors: Paul L. King; Joseph E. Grimes; Richard C. Cochran, all of Ithaca, N.Y.

[73] Assignee: Cornell Research Foundation, Inc., Ithaca, N.Y.

[21] Appl. No.: 188,030

[22] Filed: Sep. 26, 1980

Related U.S. Application Data

[63] Continuation-in-part of Ser. No. 91,862, Nov. 6, 1979, abandoned.

[51] Int. Cl.[4] ..... B41J 5/08

[52] U.S. Cl. ..... 400/110; 400/83; 400/484; 340/706; 340/712

[58] Field of Search ..... 178/30; 400/83-85, 400/109, 110, 111, 484, 477-479.2; 340/706, 735, 751, 712, 799, 365 VL, 711, 790

[56] References Cited

U.S. PATENT DOCUMENTS

| | | | |
|---|---|---|---|
| 1,204,326 | 11/1916 | Stickney | 400/82 |
| 1,600,494 | 9/1926 | Stickney | 400/484 |
| 1,687,939 | 10/1928 | Jones | 400/484 |
| 2,471,807 | 5/1949 | Yen | 400/110 |
| 3,325,786 | 6/1967 | Shashoua et al. | 400/110 X |
| 3,541,511 | 11/1970 | Genchi et al. | 340/146.3 H |
| 3,631,956 | 1/1972 | Choi | 400/111 |
| 3,651,461 | 3/1972 | Holt | 340/146.3 AC |
| 3,665,450 | 5/1972 | Leban | 340/741 |
| 3,809,203 | 5/1974 | Ogawa et al. | 400/110 |
| 3,809,204 | 5/1974 | Ogawa | 400/110 |
| 3,820,644 | 6/1974 | Yeh | 400/110 |
| 3,936,664 | 2/1976 | Sato | 364/523 |
| 3,950,734 | 4/1976 | Li | 400/110 X |
| 3,970,991 | 7/1976 | Kawada et al. | 340/146.3 AC |
| 3,999,167 | 12/1976 | Ito et al. | 364/900 |
| 4,061,998 | 12/1977 | Ito | 340/146.3 AC |
| 4,079,482 | 3/1978 | Yeh | 400/110 X |
| 4,096,934 | 6/1978 | Kirmser et al. | 400/110 |
| 4,144,405 | 3/1979 | Wakamatsu | 400/110 X |
| 4,193,119 | 3/1980 | Arase et al. | 340/751 X |

FOREIGN PATENT DOCUMENTS 2033633 5/1980 United Kingdom .

OTHER PUBLICATIONS

"Chinese Typewriter System", *IBM Technical Disclosure Bulletin,* vol. 19, No. 1, Jun. 1976, p. 320.

*Primary Examiner*—Paul T. Sewell
*Attorney, Agent, or Firm*—Jones, Tullar & Cooper

[57] ABSTRACT

A method and apparatus for electronic typing of symbolic language texts is disclosed. A twelve-key keyboard utilizing a modified four-corner identifier system permits construction of a first shape identifier code utilizing indicia which represent the shape of a character to be reproduced. Alternatively, a phonetic identifier code utilizing a phonetic alphabet can be constructed to represent the character. The identifier code is used to select one or more characters stored in a data processing system memory, each character selected by the shape identifier code having the same four-corner identifier indicia, and each character selected by the phonetic identifier code having the same phonetic spelling. Only a limited number of characters can be uniquely identified by either the four-corner system or the phonetic spelling system; for the remainder of the characters, a single set of indicia or a single phonetically spelled word can represent two or more characters, and thus ambiguities exist in the selection process. If the word to by typed comprises a single character, means are provided for manually disambiguating the characters selected by the indicia code. If the word consists of two syllables, means are provided automatically to disambiguate the word in accordance with known character pairings. If more than one such pairing exists for a given identifier code, additional means are provided for manually disambiguating the pairs. Means are provided for storing and/or displaying the unique character or character pair which results from the selection process.

39 Claims, 18 Drawing Figures

| 7A | 7B | 7C |
|---|---|---|

| 6A | 6B |
|---|---|

ELECTRONIC KEYBOARD SYSTEM AND METHOD FOR REPRODUCING SELECTED SYMBOLIC LANGUAGE CHARACTERS

CROSS-REFERENCE TO RELATED APPLICATION

The present application is a continuation-in-part of copending application Ser. No. 91,862 filed Nov. 6, 1979, now abandoned.

BACKGROUND OF THE INVENTION

The present invention relates, in general, to a system for producing in text form a manuscript which is to be written in a language utilizing symbolic characters. More particularly, the invention relates to the method of and to electronic equipment for carrying out such a procedure through the use of a unique identifier code which is generated to identify selected aspects of each character in the text. The identifier code so produced operates to select one or more previously stored characters for use in reproducing the manuscript characters in a text form for display or printing, the system thus effectively comprising an electronic typewriter for such characters.

The use of ideograms and logograms as the graphic symbols in written languages is found in many parts of the world. An ideogram is a graphic symbol used to represent an object or an idea without expressing, as in a phonetic system, the specific sounds which form the name of that object or idea. Thus, it is a symbol representative of an idea, rather than of a word. A logogram is a letter, character, or other graphic symbol used to represent an entire word. The use of logograms and ideograms is typified by Chinese, Japanese, Korean, and like languages, but for purposes of illustrating the concepts of the present invention specific reference will be made herein to a preferred embodiment of the system and method as it applies to the Chinese language.

Among the world's writing systems, Chinese orthography stands out because phonetic representation is a minor factor in its construction. There is no alphabet or syllabary from which Chinese characters are built, in contrast to other written languages, such as English, which employ alphabets having a relatively small number of digits or letters which are arranged in specific sequences and directions to permit classification of the words on the basis of the letters' conventional locations in the alphabet. As a result, alphabetically written, in contrast to symbolically written languages, are amenable to type-setting, typewriting, telegraphy, and sorting through assembly and disassembly of the letters. Further, the arrangement of the letters in alphabetically written languages is often phonetic so that the sound representation can be deduced from the particular arrangement, while only a hint of sound representation can be deduced from Chinese characters, and that only after one has learned a considerable number of them. As a functional writing system in modern Chinese, the characters can best be described as discrete units, or ideograms, which represent specific meanings. They can be learned by rote and can be retained in the memory only by frequent use. A repertoire of between 2500 and 3000 ideographic characters is necessary to achieve normal business adequacy in reading and writing, while the language itself has approximately 50,000 characters that have been identified historically, with about 10,000 characters being in current use.

Traditionally, the Chinese characters are classified by their shapes, not by the correspondence to linguistic forms. Accordingly, the problem of reproducing the characters mechanically has been extremely difficult, and it has been virtually impossible to derive adequate indexing methods. Each character contains one or more of some 214 meaning classifiers or radicals, with further classification being by the number of penstrokes in the remainder of the character. Further, the radicals themselves are classified by the number of strokes in them, but these are meaning classifiers, and do not ease the problems discussed above.

Because there is no straightforward system for indexing characters by their relation to elements of the language, the technology for printing has stayed at a rudimentary stage in the Chinese language until very recently. Although movable type was invented by the Chinese, the very nature of their writing system hindered any technical advance beyond the use of hand-set type or hand-drawn reproduction of characters. The origins of the Chinese system of writing can be traced back six thousand years, but the efficient use of modern communications and data processing systems has effectively been blocked by the problem of rapidly locating the desired character or characters to be printed. An early example of this problem appeared with the development of telegraphy, for in order to transmit messages it became necessary to assemble a telegraphic code which consisted of the International Morse Code combinations for the numbers 0 through 9,999 which were used as labels for 10,000 of the 50,000 Chinese characters. The "Telegraphic Code" was published, and the telegraph book was used by both the sender and the receiver of a message. The sender looked up each Chinese character in turn and transmitted the Morse Code representation of the number assigned to that character, while the receiver used the same book to reconvert the number to the Chinese character. Such a slow and painstaking method of transmitting a Chinese text, and the equally slow method of printing by the use of hand-set type or the use of hand-drawn pages of characters has resulted in numerous attempts over the years to develop more satisfactory solutions.

Among early attempts at solving the foregoing problems were mechanical typewriters which attempted to provide a mechanical keyboard arrangement for reproducing selected ideographic characters. Such typewriters, however, typically are nothing more than small manipulators for lead type wherein an operator sits before a case of several thousand type slugs arranged by radical and stroke count. The operator searches through the display of characters, which may, for example, be identified on a large and complex keyboard, and uses a pointer/printer linkage to retrieve the desired slug, print the character, and return the slug to its tray. A great deal of practice is required to achieve some degree of facility with such a machine; a maximum speed of about eleven characters per minute can be attained, with normal type speeds being in the range of five or six characters per minute. Although many attempts have been made to improve the mechanical typewriter, as by providing machines which will print certain strokes and radicals so that the characters can be mechanically constructed, nevertheless, the very nature of the Chinese ideogram prohibits effective mechanical reproduction by means of a typewriter. Similar problems exist with the written forms of other languages which similarly utilize graphic symbols rather than an alphabetical representation of words.

In an attempt to overcome some of the problems presented by the Chinese language ideographs, a phonetic system of spelling Chinese syllables through the use of a romanized alphabet was devised, and has been widely promoted in China. This phonetic spelling, known as the pinyin system, is based on the sound of the spoken Chinese syllables. However, because Chinese syllable structure allows a limited number of possible sound combinations, a single syllable sound is ambiguous in that it will usually identify a large number of characters. This presents little problem with the spoken word in conversation, since the intended meaning usually is apparent from the context or from particular word phrases and compounds. But because of the ambiguity as to which character is meant by a particular syllable sound, the introduction of the pinyin system and other like phonetic systems for languages other than Chinese did not solve the problem of reproducing specific ideographic characters in a manuscript by a typewriter.

With the advent of computer technology, it was recognized that a new tool had become available for use in the fast and accurate production of Chinese ideograms. Accordingly, various research and academic institutions, companies, and individuals have for many years worked on the development of electronic data processing machines and methods for producing Chinese characters. At the present time, this art has been developed to the point where computers can generate adequate ideographic shapes, and sophisticated character generators and hard-copy printing units have been developed that have the flexibility to produce acceptable Chinese characters with high resolution. Various optical readers, matrix systems, and expanded memory storage systems have made it easy to store in a data processing system the information necessary to reproduce a specified Chinese character. But even with such developments the essential problem of selecting which character should be printed or displayed remains a major stumbling block. In a typewriter system where it is desired to transfer a manuscript document to printed form, for example, the problem still remains that there are some 50,000 Chinese characters from which to select, and there has been until now no convenient, accurate and rapid method or apparatus for identifying a particular character, locating it in the processing system memory, and causing the correct character to be printed. A number of approaches have been suggested in the prior art and some have been marketed, but none has provided a satisfactory typewriter operation.

One approach has been to provide a device that stores standard character particles in a memory. An operator then uses coded sequences on an alphanumeric keyboard to assemble the desired characters on a particle-by-particle basis on a cathode ray tube. After completion of the assembly procedure, the displayed character can be reproduced on a hardcopy device. Essentially, this approach is an electronic reproduction of the pen or brush technique wherein each part of a character is constructed by hand, one stroke or one radical at a time.

Another approach has been simply to copy electronically the type tray and movable arm technique of mechanical typewriters. In this arrangement, a character table is displayed on a tablet surface, the operator hunts for the character which is required, and then touches that character location on the tablet with an electronic pen to produce the character code. This code is then fed to a computer and results in the printing of the selected character. However, this is a "hunt-and-peck" process which does hot facilitate speedy typing.

A recent approach to the problem of typing Chinese ideographs is discussed in U.S. Pat. No. 4,096,934 to Kirsmer et al., in which a computer is employed to store a catalog of Chinese characters. The characters are retrieved by means of a completely phonetic indexing system in which an ideograph is identified by spelling the pronunciation and/or by using the phonetic symbols themselves to describe the geometry of the character or parts of the character or to describe meanings of the character. All the standard Chinese characters are described phonetically, and this information is stored in the computer. However, a single phonetic word does not uniquely describe a single Chinese character, so a second sequence of phonetic symbols is provided to describe the shape or some descriptive characteristic of each character. To recover a specific character, then, two sequences of phonetic symbols are required. If that still does not identify the desired character, then additional sequences of phonetic symbols representing either the appearance of or the pronunciation of brush strokes or radicals must be encoded. This process, which requires plural encoding steps to recover a single character, is extremely complex and time consuming, and thus does not meet the need for a simple, accurate and rapid typing method.

Still another approach has been to utilize the existing mechanical typewriter, while adding the capability for producing a paper tape having optical markings that correspond to the mechanically selected type characters. The resulting tape can then be scanned electronically to produce a code which may then be fed to a computer for electronic generation of character displays or for operation of a high-speed printing device. Although this system allows faster reproduction of the typed material, the process of selecting the characters to be typed remains the same; namely, slow and tedious.

In an effort to reduce the time required to identify to a character generator the particular ideogram to be reproduced, so called "four-corner" coding schemes have been developed which attempt to classify Chinese characters by the particular shapes which appear at each of the four corners of the character. These four shapes can then be used to identify and retrieve characters from a computer memory. This approach is similar to the above described procedure of constructing desired characters through the selection of character particles, and to a more recent approach which uses a three element character construction scheme using a one-hundred radical keyboard. Such systems of identifying Chinese characters by selecting only portions of the character have a serious and common fault: even with very sophisticated coding systems, the use of only selected portions of a character for identification purposes does not uniquely identify a single Chinese character every time. This is because there are many characters which have the same general stroke or radical configurations on their periphery, but have different shapes at the center position so that the use of the so-called "four corner" or "three corner" codes have always resulted in ambiguities which have prevented effective use of such systems.

SUMMARY OF THE INVENTION

The present invention provides a new and unique typewriter system and method which overcomes the difficulties of prior systems and enables an operator to type symbolic graphical characters such as Chinese language ideograms or logograms at much higher speeds than was previously possible. In a preferred embodiment, the invention utilizes a modified "four-corner" shape recognition encoding system and an associated keyboard arrangement which are unique in that they permit a rapid entry of identifying characteristics into the system and rapid retrieval of the corresponding character from the system for suitable reproduction. In a second embodiment of the invention, a phonetic encoding system and an associated keyboard are provided for the same purpose. The system of the invention is further unique in its provision of an apparatus and method for resolving the ambiguities which are inherent in such encoding systems because of the characteristic of symbolic language. The modification of the four-corner identification system or the phonetic encoding system combined with the method and apparatus for resolving ambiguities provides a substantial and unexpected advance in the art of typing graphic symbols such as Chinese characters. The invention greatly reduces the time required for an individual to learn to reproduce ideographic characters, and results in a many-fold increase in the number of characters which can be typed in a given time period.

In accordance with the invention, then, there is provided a data storage system having the capability of generating a large number of Chinese language ideograms, logograms or like symbolic characters. The data required to generate each character are stored at a predetermined location in the data storage system memory so that, upon demand, selected characters may be located, generated, displayed on a conventional optical display such as a cathode ray tube, and printed by means of a conventional printer or stored for later display and/or printing. The storage and generation of such characters may be accomplished by any number of known techhiques, for example, through the use of optical readers, electronic contact pen devices, or the like.

Also provided in the system of the invention is a storage file of Chinese character pairings. This file includes for each character stored in the character memory a listing of other characters with which it might be combined to make a two-syllable word, or compound. This is done in view of the fact that over sixty percent (60%) of Chinese words consist of a pair of characters, rather than a single character. One key to the present invention lies in the recognition that such pairings provide a tool for the automatic removal of ambiguities in the selection of a character, and accordingly the invention provides a method and apparatus for utilizing this file of pairings in the rapid reproduction of the desired Chinese characters for the typing of a manuscript.

In both embodiments, information concerning the symbol to be typed is supplied to the system by way of a keyboard in which the keys represent predetermined characteristics of the symbol, such as its shape or some aspect of its appearance, sound, usage or the like. In the preferred form of the invention, a twelve-key keyboard is provided in which ten keys represent ten peripheral stroke configurations found in Chinese ideograms. These stroke configurations permit rapid identification of an ideogram, production of a corresponding identifier code, and entry of the code into the system. The remaining two keys are provided to serve as delimiters, one signaling the space between characters in a pair and the other indicating the end of a simplex character or the end of a pair of characters. In using this system, the typist inspects the manuscript which is to be typed, and operates the keyboard to produce a series of signals which constitute an identifier that is coded in accordance with the peripheral stroke configuration of the particular character or pair of characters that are to be typed. Means responsive to the identifier codes of each character recall from a data processing system memory all of the characters which have that identifies code, and which, therefore, have similar configurations.

In the second form of the invention, a standard computer terminal keyboard having the conventional alphabetical symbols is used. This keyboard is used to type the pinyin spelling of a Chinese or other ideographic character, and to facilitate its use, no changes are made in the location of the conventional alpha symbols. Because the pinyin system does not use the letter "v", only 25 alpha symbols are required. In addition, since pinyin requires the use of superscripts to symbolize tone, the keys representing selected conventional punctuation symbols are used to denote tones.

The standard keyboard is used to provide a series of key inputs representing the phonetic spelling of an ideogram, thereby producing an identifier code for the ideogram that is to be typed. This phonetic identifier code is used to recall from the data processing system memory all of the characters which have that identifier code and which, therefore, sound the same when spoken and have the same phonetic spelling.

As indicated above, because of the nature of symbolic language in general, and the Chinese ideogram in particular, numerous characters may have the same peripheral strokes or radicals, while the interior of the character may have a wide variety of strokes or radicals. Similarly, the nature of such a symbolic language results in a large number of phonetically identical words. Accordingly, a given identifier code, either based on shape or on phonetics, may call up a large number of characters, but usually not more than 15, which are similar in appearance or pronunciation but which may be widely divergent in meaning, thus producing an ambiguity which must be resolved.

Where a word involving only a single character is to be typed, a manual procedure for resolving the ambiguity is provided by the present invention, and thereafter the proper character is supplied to an appropriate display, text storage file, printer, or the like. However, where the word to be typed consists of two syllables (or characters), the peripheral stroke configuration information or the pinyin spelling is supplied for each of the two characters, producing a coded identifier for each character. In the case of a shape identifier, all characters having the peripheral stroke configuration corresponding to the first identifier code are called up and are stored in a first location, the characters being accompanied by a pairing list which indicates second syllables that can be paired with them. If the identifier code represents a pinyin input, then all characters having a sound corresponding to the first identifier code are called up, together with a pairing list for each. Thus, in either embodiment, the first storage location will contain a list of all of the possible characters that correspond to the first identifier code entered through either keyboard, and each such possible character will be accomplished by a list of other characters with which it might be paired in forming a word. Means are further provided to locate and store in a second location all of the characters which correspond to the identifier code selected by the typist as identifying the peripheral stroke configuration or the pinyin spelling of the second character to be typed. This second location will not contain pairing information, since such information is not required for the second character.

The system includes means for selecting the first character in the first location and for comparing each of its possible pairings with each of the characters in the second location, for thereafter selecting the second character in the first location and comparing each of its possible pairings with each of the characters in the second location, and so on, until all of the pairings in the first buffer have been compared to the characters in the second buffer. Each time a possible pairing from the first buffer finds correspondence with a character in the second buffer, the identifier codes of that pair are stored, and if upon completion of all of the comparisons only a single pair of identifier codes is so stored there will have been a unique selection of the pair of characters which meets the peripheral stroke configuration or the pinyin spelling criteria of the typist, and the desired word has been selected automatically and without ambiguity.

If more than one pair is selected during the comparison process, means are provided for storing each of the selected pairs. Although storage of a plurality of such pairs indicates that there has not been a complete disambiguation, greatly reduces the number of characters to be considered by the operator. Further means are then provided for displaying first one and then another of the selected and stored pairs so that the typist can manually choose the desired character pair for storage in a display buffer, text storage location, or the like for immediate display of the chosen character pair, for printing of those characters, or for storage for future use.

In accordance with the foregoing, there is provided a unique method and apparatus for typing graphic or symbollic language texts, particularly those utilizing Chinese characters, rapidly and accurately, the system of the invention overcoming the difficulties of prior typewriter devices.

BRIEF DESCRIPTION OF THE DRAWINGS

The foregoing and additional objects, features and advantages of the invention will become apparent from a consideration of the following detailed description of a preferred embodiment thereof, taken in conjunction with the accompanying drawings, in which.

DESCRIPTION OF PREFERRED EMBODIMENTS

Figure 1A:
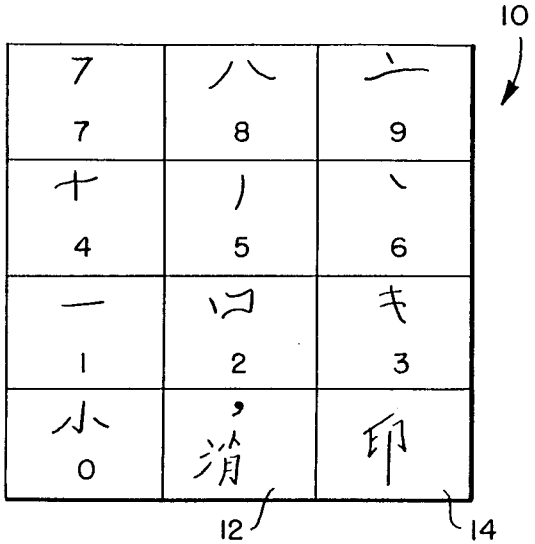
FIGS. 1A and 1B are diagrammatic illustrations of keyboards used with the system of the present invention.
Figure 1B:
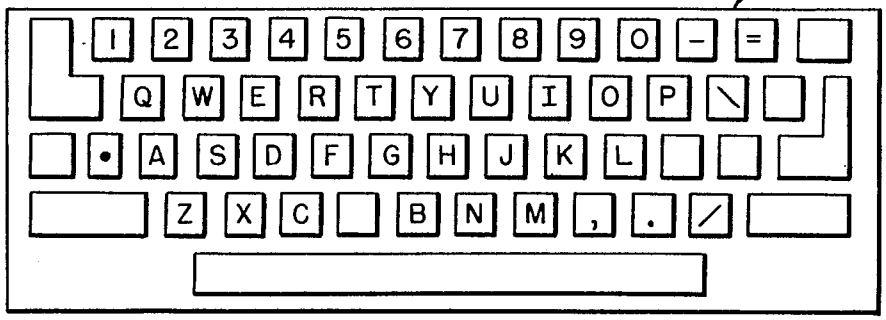

The aspect of typing ideograms, logograms or like characters that produces the greatest difficulty to both the typist and the designer of the typewriter is the problem of identifying the particular character desired. When the selection must be made from the 50,000 Chinese characters historically available, or even from among the 10,000 characters in current use, this identification becomes a slow, time-consuming task. By the use of either or both of the keyboards illustrated in FIGS. 1A and 1B, however, the identification and selection of a character for printing, typing, display or the like, is greatly facilitated. The keyboard 10 shown in FIG. 1A is a shape identification board which enables a typist to operate the system of the invention in a shape recognition mode by inspecting a character and producing a shape identifier code rapidly and accurately through the use of a modified "four corner" coding system. The keyboard 11, shown in FIG. 1B, is a pinyin keyboard which enables a typist to operate the system in a phonetic typing mode by producing an identifier code based on the pronunciation of the character so that the typist who speaks the language can use the phonetic spelling of the character/word as the basis for typing. Either keyboard may be used to call up a given character, and if desired, the keyboards may be used interchangeably in typing a series of characters, so that the system may be operated in the shape recognition mode or the phonetic mode as desired by the typist. Although the present invention is illustrated as having both the phonetic and the shape recognition modes, it will be apparent that the system of the invention may be constructed with only one mode, if desired. However, of the two, the shape recognition mode represents the preferred embodiment of the invention, with the phonetic mode representing an alternative method of providing coded data representative of a character to be produced.

In accordance with the preferred embodiment of the present invention, the individual keys on key pad 10 display ten basic stroke configurations which are found at the extremities of Chinese ideograms, and these stroke configurations are used to identify the character to be typed. This key pad may be a standard alphanumeric twelve-key keyboard, with ten of the keys carrying the Arabic numerals 0–9, and the two additional keys 12 and 14 carrying indicators for character delimiter functions, key 12 providing a comma (",") between adjacent characters and key 14 providing an "end of word" or "print" indication. The Arabic numerals not only identify the keys 0–9, but are used for manual disambiguation, as will be described below. Although the key pad 10 is shown as a separate unit, it will be understood that, if desired, it can be integrated with a standard typewriter-style keyboard, either as separate keys or as an overlay. This may be conveniently done with a conventional computer input terminal keyboard.

The placement of the several stroke configurations on the various keys is determined by shape association, frequency of use, and the usual positions of the strokes in Chinese characters, so that there is a natural relationship between the keys and the characters that are to be typed. Thus, the stroke configuration on key 1 is the Chinese number 1; the configuration on key 7 looks like the Arabic numeral 7, and the configuration on key 8 is the Chinese number 8.

Among the seven remaining stroke configurations, those indicated on keys 5, 4 and 6, respectively, are the most frequently used, in descending order of frequency. Those are, therefore, placed on the keys which are the normal rest positions for the operator's fingers, so that the operator need not shift his fingers in order to select those configurations. In addition to being frequently used, there are additional associations for the stroke configurations on keys 4 and 6. The configuration on key 4 is the Chinese number 10, which is pronounced "shi" in Mandarin Chinese. The number 4 is pronounced "si" in Mandarin. Although this pronunciation of the numbers 4 and 10 is similar, it is even more so for southern Chinese dialects, particularly Taiwanese, which does not have a retroflex sibilant in its dialect. For the latter dialect, both the numbers 4 and 10 are pronounced "si" in Mandarin, with only a difference in tone, and in common speech the two numbers often are confused. This phonetic affinity is used in the keyboard 10 by placing the stroke configuration for the number 10 on key 4, thus enabling an operator to quickly learn the location of the particular configuration, and facilitating the use of the keyboard.

The frequently used configuration on key 6 of pad 10 is one which often appears on the right side of a character, and thus there is a positional association between the location of the stroke on the character and its location on the keyboard.

The remaining four stroke configurations are the least frequently used of the ten selected configurations. The one illustrated on key 9 always appears at the top of a character, and thus is placed on the top line of keys. Similarly, the configuration on key 3 is often at the lower right portion of a character while the configuration on key 2 is usually somewhere in the bottom half of a character.

The least frequently used stroke configurations is that illustrated on the "0" key. This key is furthest from the most frequently used key, and thus provides a double association for the typist: the frequency of use is least, so it is on the lowest number, and it is furthest in location from key 5. In addition, this configuration represents a shape that is usually found in the bottom portion of a character.

The configurations shown on keyboard 10 are used by a typist to identify portions of a character to be typed, so as to call that character from the processing system memory. The process of identification is built on the known "four-corner" system, wherein the ten stroke configuration types described above are used to produce a code which corresponds to the character. On the basis that a Chinese ideogram is basically square in appearance, a four-digit code can be produced from the above-described key pad 10 by identifying various stroke shapes in the four quadrants of a character: the upper left, upper right, lower left, and lower right, and by depressing the corresponding keyboard keys in that sequence. This produces a series of keyboard signals, which for convenience may be referred to as a series of corresponding keyboard numbers, which constitute an identifier code for the character. When this code is determined by the shape of the character, it will herein be referred to as a shape identifier code.

The previously known four-corner system for identifying ideograms required a four-digit code number to identify every character, whether or not that character had four identifiable corners. In the case where there was not an identifiable stroke configuration, the prior system required insertion of a "0" (or null); however, since the 0 key also represents a specific stroke configuration, the prior four-corner system had a built-in ambiguity. Further, since the prior system required a null identifier, the use of that system resulted in the generation of numerous unneeded signals. In fact, in one sampling it was found that a null signal appeared in about 53% of the characters, and thus introduced ambiguities or extra key strokes in a majority of characters to be typed. In accordance with the present invention, however, the null key stroke of the four-corner system is eliminated, so that the zero key is only used to provide identification for a stroke shape actually appearing in the character to be typed. Thus, for example, the Chinese character "/" has all four corners covered by a single stroke; however, the prior four-corner system required the typist to identify it with four key strokes: a "1" and three null indicators, to provide a code number of 1000. Under the new four-corner system of the invention, the character may be identified by a "1" key stroke alone.

The new four-corner encoding system thus has the advantage that while simple characters can be identified by as few as one code number, more complex characters have additional identifier code positions available, and this increase in stroke categories serves to reduce the ambiguities which occur as a result of the typing process. Further, the typist need not remember to add null zeros when reading an ideogram; it is only necessary to identify the shapes that are actually present in the character so that, on the average, fewer key strokes are required in typing the characters.

Figure 3:
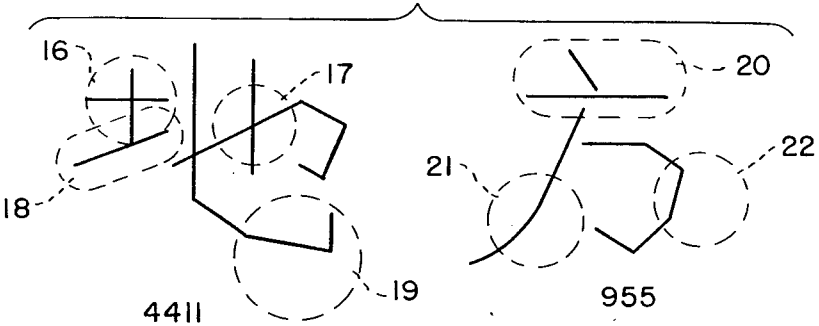
FIG. 3 is an illustration of the application of the modified four-corner shape identifier code used in the present invention.
Figure 2:
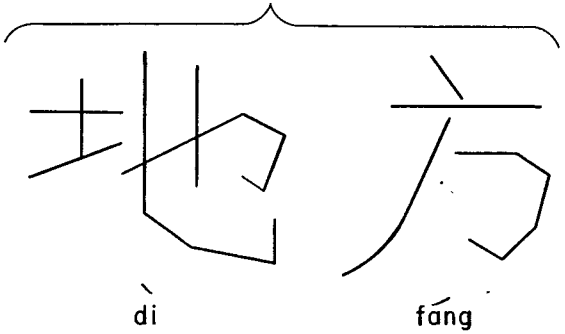
FIG. 2 is a diagrammatic illustration of a pair of Chinese characters.

An example of the use of the stroke configuration displayed on the key pad 10 of FIG. 1A to encode Chinese ideograms is illustrated in FIGS. 2 and 3, wherein the Chinese characters "dì" and "fāng" are diagrammatically illustrated. These characters may be translated into English as "land" and "area", respectively, and when used together as the single, two-syllable word (or word phrase) dìfāng, may be translated as meaning "place". The character "dì" may be identified by the stroke configurations indicated within the dotted circles 16, 17, 18 and 19 in the four quadrants of the character, and a comparison of these configurations with those on the keyboard 10 illustrates that the character may be identified by the new four-corner system of encoding by striking keys, 4, 4, 1 and 1 in sequence, giving the shape identifier code 4411 for that character. It will be understood that the illustrated numeric code is exemplary of the presently preferred form of this invention, and that other numerical, alphabetical or symbolic codes may be provided, the particular indicia used being a matter of choice and in part dependent upon the particular keyboard being used.

The character "fāng" similarly may be encoded through use of the new four-corner system, wherein the upper left, lower left, and lower right quadrant configurations 20, 21 and 22, are respectively represented by the keys 9, 5 and 5, respectively. Note that no stroke configuration need be identified for the upper right quadrant, and that no filler key stroke is required; thus, no ambiguity is created by the encoding process. The identifier code 955 thus represents the character "fāng", as illustrated in FIG. 3.

When typing Chinese characters by means of the electronic typewriter system of the present invention, in the shape recognition mode, the typist looks at the character to be reproduced, and by use of the new four-corner system described above, strikes selected keys on keyboard 10 in sequence to produce an identifier code for that character. The keyboard produces corresponding signals which are fed into the data processing system (to be described) to call up the character so selected. Although the identifier code selected by the operator for a particular character will often call up the desired character, the complexity of the Chinese ideogram, the manner in which it is constructed, and the large number of characters in the Chinese language result in a large number of characters which closely resemble each other, and it often happens that a given identifier code will call up more than one character from the data processing system; i.e., will produce an ambiguity. An example of this ambiguity is illustrated in FIG. 4, with respect to the character "fāng".

Figures 4A, 4B, 4C, 4D, 4E, 4F:
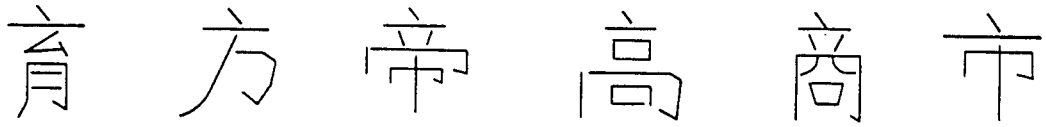
FIGS. 4*a*–4*f* illustrate a plurality of Chinese characters all having the same shape identifier codes.

As noted, the character "fāng" of FIG. 2 may be identified in the new four-corner system by the shape identifier code 955. However, this code number only refers to peripheral characteristics of the ideogram, and a number of other characters having distinct configurations and meanings have the same identifier code. FIGS. 4*a*–4*f* illustrate six ideograms having the identifier number 955, as follows:

FIG. 4*a*: yù, meaning "education" (Telegraph Code 5148);

FIG. 4*b*: fāng, meaning "area" (Telegraph Code 2455);

FIG. 4*c*: dì, meaning "emperor" (Telegraph Code 1593);

FIG. 4*d*: gāo, "height" (Telegraph Code 7559);

FIG. 4*e*: shāng; meaning "commerce" (Telegraph Code 794);

FIG. 4*f*: shì, meaning "marketplace" (Telegraph Code 1579).

It is noted that the "Telegraph Code" number is the number assigned to each character in the standard Telegraph Book that has been in use for many years to provide means for identifying particular Chinese characters.

When the system of the invention is used in the phonetic mode, the keyboard 11 illustrated in FIG. 1B may be used. This may be a standard typewriter-style keyboard, and niently is a conventional computer input terminal keyboard. All of the alpha symbols, with the exception of the letter "v" are used, and thus no overlay or modification of the board is needed. However, since the phonetic pinyin system utilizes superscripts as well as alpha symbols, standard keys carrying the standard symbols "–", "/", "=", and "\" may be used to represent the first, second, third and fourth tones, respectively.

Although the tone marks in standard pinyin transcriptions are written as superscripts over syllabic vowels, in accordance with the present invention the pinyin words are typed on keyboard 11 simply by typing the needed tone mark in sequence after the spelled syllable is typed. Thus, for example, a pinyin syllable such as "shī" is typed on keyboard 11 as "shi-", the syllable "dì" is typed "di]" and the syllable "fāng" is typed "fang/".

The pinyin alpha symbols and tone marks serve the same function as the shape identifiers of key pad 10, in that they produce an identifier code which corresponds to the ideographic character to be typed. In the case of the key pad 10, the identifier code is a series of numbers (e.g., 4411 and 955), which correspond to the shape of the character, while in the case of keyboard 10, it is a series of alpha and tone symbols which correspond to the sound, or pronunciation, of the character.

Although the identifier codes produced in accordance with this invention do not themselves introduce ambiguities, a given code may call up more than one character from the system, and accordingly, both manual means and automatic means for disambiguating the identified characters are provided. These means take advantage of the fact that while a Chinese ideogram represents a single syllable in the language, many Chinese words consist of two characters in a pairing to make a compound, or word phrase. It has been found in accordance with the present invention, that by typing these compound word pairings in sequence, most of the ambiguities due to similarities in shape or pronunciation can be eliminated. Thus, for example, if only one of the many characters in FIG. 4 identified as 955 can be paired with only one of the characters which might be identified as 4411 (FIG. 3), then when the typist calls for the pair 4411, 955, the pairing of FIG. 3 will be uniquely identified, thus eliminating the ambiguities that would otherwise exist for 4411 standing alone and for 955 standing alone. The same pairings exist, of course, when the identifier code is based on pinyin instead of shape characteristics.

It is possible that for some identifier code pairings there will still be ambiguities, since there are some identifiers which call up multiple Chinese character pairings. When this occurs, means are provided to display the multiple pairings in sequence, for manual disambiguation. This manual disambiguation is also available when a single character is to be typed, where automatic disambiguation cannot be used. The manual operation provides a rapid display of the various choices available to the typist, who may then select the desired character for printing or storage. This allows the typist to proceed quickly to the next character to be typed, enabling the typist to achieve typing speeds not previously possible.

Figure 5:
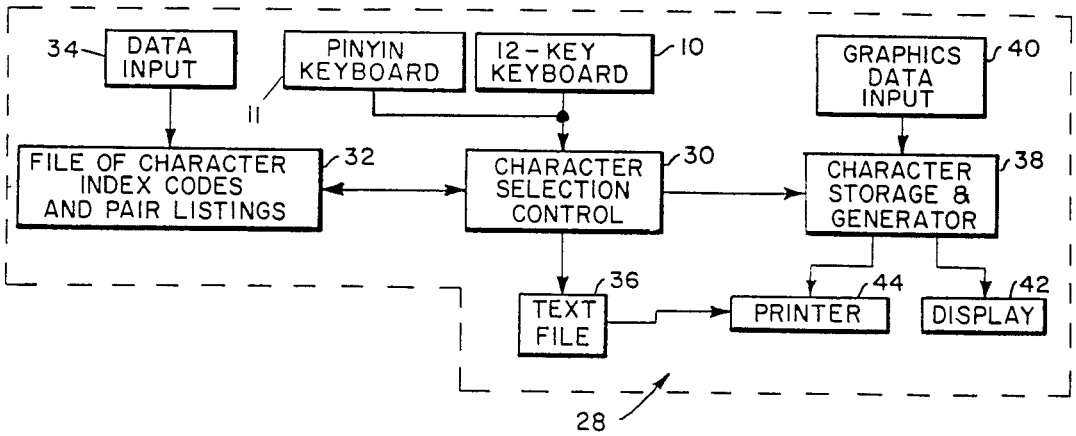
FIG. 5 is a block diagram of a system for eliminating ambiguities in the selection of a Chinese character, in accordance with the present invention.

The system of the present invention is disclosed in block diagram form in FIG. 5, which illustrates at 28 a data processing system having a character selection control logic section 30 (to be described) which is operated under the control of the keyboards 10 and 11 shown in FIGS. 1A and 1B. The control logic responds to instructions from either keyboard to call up the desired characters from an addressable storage section or memory 32, which may, for example, be a disc or other read-only memory. The memory 32 receives, by way of data input 34, information files which relate specific Chinese characters to specific identifier code indicia, so that the typing of shape or sound identifiers on keyboards 10 or 11 will produce identifier codes which will cause logic section 30 to call up, or retrieve, the corresponding character or characters. Preferably, each character has a unique index code by which it is cataloged in storage section 32. Conveniently, the Telegraph Code may be used for this purpose, although other index codes may be used.

Also stored in section 32 is the pairing information for each character, listing the other characters with which it may be paired to form a two-syllable word. In this listing, the character is considered to be the first of a pair, with the pairing information identifying which characters may be used as a second syllable. Thus, when the shape identifier code 4411 ("di" in FIG. 2) is used to call up a character, section 32 provides a listing, by index code (here, the Telegraph Code) of those characters which have the identifier number 4411, together with a listing, by index code, of characters which might be paired with the selected characters. Thus, 4411 calls up the following information:

TABLE I

| Identifier Code | Telegraph Index Code | Pairings (Telegraph Index Code) |
|---|---|---|
| 4411 | 966 | (7240, 7, 31, 143, 690, 1601, 2455, 2975, 3810, 4122, 4318, 3808, 528, 7191, 7820) |
| | 5413 | (5413) |

Note that the character having Telegraph Code 966 can be paired with fifteen other characters, while the character having Telegraph Code 5413 can only be paired with itself.

The file section 32 similarly contains for the identifier number 955 the following information:

TABLE II

| Identifier Code | Telegraph Index Code | Pairings (Telegraph Index Code) |
|---|---|---|
| 955 | 5148 | |
| | 2455 | (3127, 4104, 7240, 2973, 143 686, 189, 1709, 11, 2088) |
| | 1593 | (79, 455, 948, 1004, 1446, 3769, 6757) |
| | 7559 | (1129, 5281, 2814, 3808) |
| | 794 | (86, 5307, 756) |
| | 1579 | (6, 198, 90, 1034, 1627, 1869, 2398, 3127, 5116, 6133, 7024, 7240, 7333) |

In similar manner the phonetic identifier codes (e.g., "di \" or "fang/") produced by keyboard 11 will cause the logic control 30 to call up any character or characters listed in file 32 as having the same phonetic code. This will result in a listing, by Telegraph Code, of all characters which sound like the typed syllable, together with their possible pairings. It will be apparent that the list of characters called up by the phonetic identifier code may differ from the list called up by the shape identifier code, even though the typist is seeking to type the same ideogram. Furthermore, the pairing lists of index codes and pairings produced by either method will contain the desired ideogram or ideogram pair, so that the disambiguation of the present invention (to be described) will produce the desired character or character pair.

When the character selection control logic 30 to be described has been operated to select the desired character or characters from file section 32 and has eliminated any ambiguity, the selected characters are stored in a text file section 36 for printing, storage, or both.

To permit the system to generate the Chinese characters selected by the typist, a character storage and generator section 38 is provided. This section is a conventional character generator such as that shown, for example, in U.S. Pat. No. 3,936,664, which may receive graphic information from a graphics data input device 40. This data input may be from a pen tracer device for direct graphical input, from an optical scanner for producing digital representations of graphical information, or from any other conventional graphics data source which will enable the system to store in section 38 the information required to allow generation of any Chinese characters selected by logic section 30.

The character generator 38 produces an output to a display unit 42 and to a printer 44 to produce the required characters. The display unit may be, for example, a cathode ray tube at the typist's table for visual display of the characters being selected. This enables the typist to verify the selection and to compare it with the original manuscript from which the characters are being typed. The display also aids the typist in manual disambiguation.. The printer 44 may be a conventional dot matrix printer for producing a printed copy of the text being typed after disambiguation has been completed.

In a preferred form of the invention currently being implemented, the data processing system utilizes apparatus such as a PDP-11/40 model computer manufactured by Digital Equipment Corporation. The keyboard 10 is a conventional 12-key pad which is used in conjunction with the data input keyboard 34 of the PDP-11/40, the keyboard 11 may be a part of the data board 34, the graphics input device is a graphics tablet manufactured by Talos Systems, Inc., the display unit 42 is a Tektronix Model 4013 CRT display associated with the PDP-11/40, and the printer is a Versatec Model 1200A Printer/Plotter manufactured by Versatec, a division of Xerox Corporation.

Figure 6B:
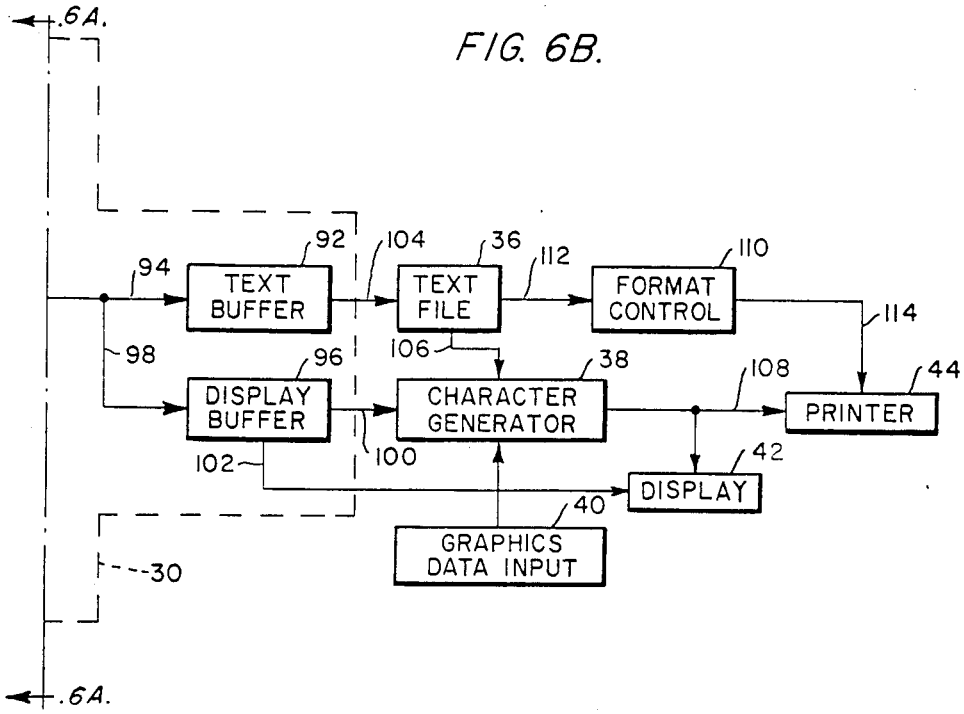
FIGS. 6A and 6B combine to form FIG. 6, and comprise a more detailed block diagram of the system of FIG. 5.
Figures 6A, 8, 9:
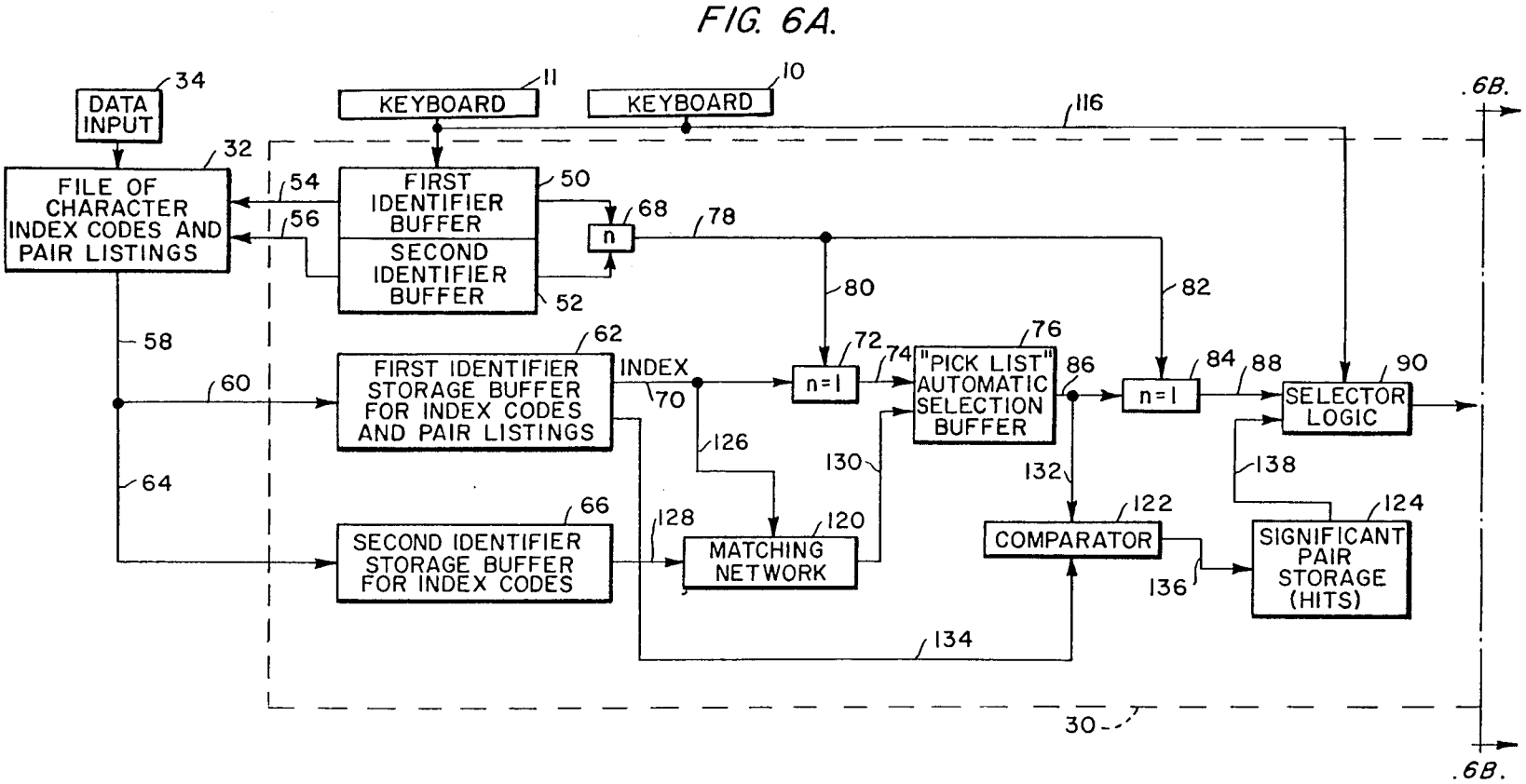
FIG. 8 illustrates the relationship of FIGS. 6A and 6B.
FIG. 9 illustrates the relationship of FIGS. 7A, 7B and 7C.

A more detailed description of the system of FIG. 5 is provided in the block diagram of FIG. 6, which incorporates FIGS. 6A and 6B, and to which reference is now made. In this block diagram, the elements of FIG. 5 are similarly numbered, and thus keyboards 10 and 11, the random access memory section or file 32 for storing character codes and pairings, the selection control circuit 30, the text file 36, the graphics data input 40, the display 42, and the printer 44 are all illustrated in FIG. 6.

The character selection control 30 incorporates a pair of identifier storage buffers 50 and 52 which receive from keyboards 10 and 11 the identifier codes for the characters to be typed. Where a single character is being typed, the identifier code is fed to buffer 50, but where a two-syllable word is being typed, the first syllable is entered in buffer 50 and the second syllable is entered in buffer 52. The characters are entered by first typing on the keyboard the identifier code for the first character which, in the example of FIG. 3, would be the shape identifier code number 4411. If this character is to be followed by a second character to form a two-syllable word, a comma (,) is typed on key 12 of keyboard 10, the "," being the symbol for the space between characters in a pair. Thereafter, the identifier code for the second character, 955 in the example, is typed and this is followed by depressing key 14 on the keyboard which carries the "print" symbol and which serves as the delimiter which is used to indicate either the end of a single character or the end of a pair of characters. It should be noted that this print symbol is used for both the shape and the phonetic identifier codes, and thus may be provided on keyboard 11 if desired.

Upon depressing key 14, the first identifier code is entered in buffer 50 (FIG. 6A) and if there are two codes, the second identifier code is entered in buffer 52. These buffers provide outputs on lines 54 and 56, respectively, to the memory file 32 to call up the information located at the addresses specified by these two identifiers. The file 32 transfers by way of lines 58 and 60 the data corresponding to the first identifier code to a storage buffer 62, transferring to buffer 62 the index codes and pair codes for all of the characters which correspond to the first identifier code. In this instance, the identifier code for the first character calls up the information indicated in Table I hereinabove and stores that information in buffer 62. In similar manner, the identifier code for the second character calls up the data from Table II hereinabove and feeds that data by way of lines 58 and 64 to storage buffer 66. This storage buffer receives the index codes corresponding to the selected characters, but since the pairs information for the second character is not required for resolving ambiguities, pairs information need not be included.

A suitable logic circuit 68 is provided to sense whether the data entered by keyboards 10 and 11 represents a single character or a two-character word. If only a single character (simplex) word is entered, there is no need for the pairs information stored in buffer 62; only the index codes stored therein are needed to identify the character to be typed. The index codes representing each of the characters which correspond to the identifier code supplied by the keyboards 10 and 11 are fed by way of line 70 through gating means 72 to line 74 and thence to a "pick list", or automatic selection buffer 76. Gate 72 transfers this index code information to the pick list when the number of character identifier codes (n) entered in the storage areas 50 and 52 is equal to one (n=1). When two sets of character identifier codes are entered (n=2), a different procedure is followed which will be discussed below. The output of logic network 68 is applied by way of lines 78 and 80 to gate 72 and is also applied by way of lines 78 and 82 to a second gate 84, the latter being operated when an identifier code representing only a single character is received from the keyboard 10 or 11 to transfer the data from the pick list buffer 76 by way of lines 86 and 88 to a selector logic network 90.

When only one character is to be typed (n=1), the selector logic 90 receives the first index code from the pick list buffer 76 and determines if it is the only one. If only one index code is in that buffer, it is transferred immediately to the text buffer 92 (FIG. 6B) by way of line 94 and to a display buffer 96 by way of line 98. The data in display buffer 96 then activates the character generator 38 by way of line 100 and the display unit 42 by way of line 102 to provide a visual display of the character. Transferring the index code to the character generator 38 calls up the specific character which is identified by that index code and the typist may then compare the displayed character with the character from the manuscript material being typed to determine whether the system has produced the correct Chinese ideogram. When only one index code is received by the selector logic, the data in text buffer 92 is automatically transferred to the text file 36 by way of line 104 for storage and for printing. If the character is to be printed, the data in the text file activates the character generator 38 by way of line 106 to generate date relating to the printing of the selected character, which information is supplied by way of line 108 to printer 44. An appropriate format control may be provided for the printer by way of format control circuit 110 which is activated by an output on line 112 from the text file and which controls the printer 44 by way of line 114.

If the identifier code for the character to be typed calls up a plurality of index codes for storage in the pick list buffer 76, the selector logic 90 selects ("picks") the first one in the list, transfers it to the text and display buffers 92 and 96, as described above and displays the corresponding Chinese ideogram. If the typist wishes to use that character, the keyboard 10 is operated, for example by depressing the "1" key followed by key 14 (the "print" key) to transfer the selected index code to the text file for printing or storage of the corresponding character. If the first index code does not display the desired character, the typist depresses only the key 14 (for example), which produces a signal on line 114 to cause the selector logic to sample all of the remaining index codes in the pick list buffer 76 and to transfer them sequentially and repetitively to the text and display buffers 92 and 96. This causes the characters corresponding to the remaining index codes to be displayed for visual selection by the typist. The typist then depresses the key or keys on keyboard 10, or equivalent keys on keyboard 11, which have numerical values that correspond to a desired selection from the displayed list, with that number being followed by the print command of key 14 or its equivalent. Thus, for example, if nine index codes are displayed, and the operator wishes to select the fifth one in the list, he depresses key 5, followed by key 14 to transfer the fifth character in the list to the text file 36.

To facilitate the foregoing selection process, the file 32 normally contains the index codes corresponding to any given identifier code in the order of most frequent use, so that when the index codes are transferred to the pick list buffer 76, the first one on the list will be the one that is most likely to be the desired character. This results in a considerable saving of time if there is an ambiguity to be resolved In the event that the Chinese word being entered by way of keyboard 10 or keyboard 11 consists of two characters, so that two identifier codes are entered into the buffers 50 and 52, the index codes of all of the characters which correspond to each of these two identifiers will be called up and stored in buffers 62 and 66, respectively. The control circuit 30 will then proceed to determine whether any ambiguities exist, and if so to resolve them. This is accomplished by means of a matching network 120 (FIG. 6A).

The matching network 120 is connected to the output of storage buffer 62 by way of lines 70 and 126 and is connected to the output of storage buffer 66 by way of line 128. The circuit scans the contents of buffers 62 and 66 to match the index codes in each of these buffers, creating a series of index code pairs which are supplied by way of line 130 to the pick list buffer 76. Thus, the matching network 120 selects the first index code stored in buffer 62 and matches, or pairs, it in turn with each of the index codes stored in buffer 66 to create a first series of index code pairs, which are then stored in the pick list buffer 76. The matching network 120 then selects the second index code (if any) in buffer 62 and matches it in turn with each of the index codes in buffer 66, creating a second series of index code pairs which also are stored in pick list 76. The matching circuit 120 continues in this manner until each of the index codes in buffer 62 is paired with each of the index codes in buffer 66 and these index code pairs are all listed in the pick list buffer 76. The pick list buffer 76 then contains a complete listing of all of the possible combinations of index codes which can be derived from the two identifier codes selected by the typist.

The index code pairs stored in pick list buffer 76 are supplied one at a time by way of lines 86 and 132 to one input of comparator 122. This comparator then compares each index code pair on line 132 with the pairs information contained in the storage buffer 62 and fed to the comparator 122 by way of line 134. In this way, all of the possible index code pairings listed in the pick list 76 are compared with the permitted index code pairings previously established for each of the characters selected by the identifier code for the first character in a word pair. Each time a possible pair on line 132 is found to correspond to a permitted pair on line 134, that pair is immediately transferred by way of line 136 to the significant pair storage buffer 124 to indicate a "hit".

After all of the possible pairs in buffer 76 have been compared to all of the permitted pairs for each of the index codes in buffer 62, the selector logic circuit 90 scans the pair storage buffer 124 to determine whether any hits have been registered and if so, whether there is more than one hit. If only a single pair is stored in buffer 124, the selector logic 90 immediately supplies that pair of index codes to the text buffer 92, to the text file 36 for storage or for printing, and to the display buffer 96 for visual display on unit 42 of their corresponding characters to permit visual inspection by the typist. When this occurs, the system has successfully resolved all ambiguities automatically to provide extremely rapid typing of the desired character pair.

If the pair storage buffer 124 contains no pairs, the selector logic 90 may be activated to display the first pair of index codes stored in the pick list buffer 76. If that pair is not accepted by the typist, then the selector logic scans each of the other pairs in buffer 76 and displays them for visual inspection by the typist and manual selection by way of a keyboard entry, as discussed above, for manual resolution of the ambiguity.

If more than one pair of index codes is present in the storage buffer 124, the selector logic 90 provides manual resolution of this ambiguity, again in the manner described above, by selecting a first pair from buffer 124 for display, and if that is not the pair desired by the typist, thereafter displaying the remaining pairs in the buffer 124 for manual selection. If none of the foregoing procedures produce the desired character or character pair, then either the typist has misidentified the desired character, or the data file does not carry that character.

Although the selection control circuit 30 is illustrated in diagrammatic form in FIG. 6, it will be understood that each of the components thereof is conventional and may be activated by conventional switching or logic circuits. Thus, for example, the matching circuit 120 may simply be a conventional stepping circuit which receives inputs from two sources by way of lines 126 and 128 and steps through one source completely for each step of the other source, producing an output on line 130 for each step. Similarly, the comparator 122 is a conventional circuit which receives data corresponding to specified index code pairs, determines whether the two inputs are identical and, if so, transfers the data to buffer 124. The selector logic 90 may be a conventional multiplexing unit which sequentially selects one of a multiplicity of inputs for transfer to a single output which is then supplied to the buffers 92 and 96.

Figure 7A:
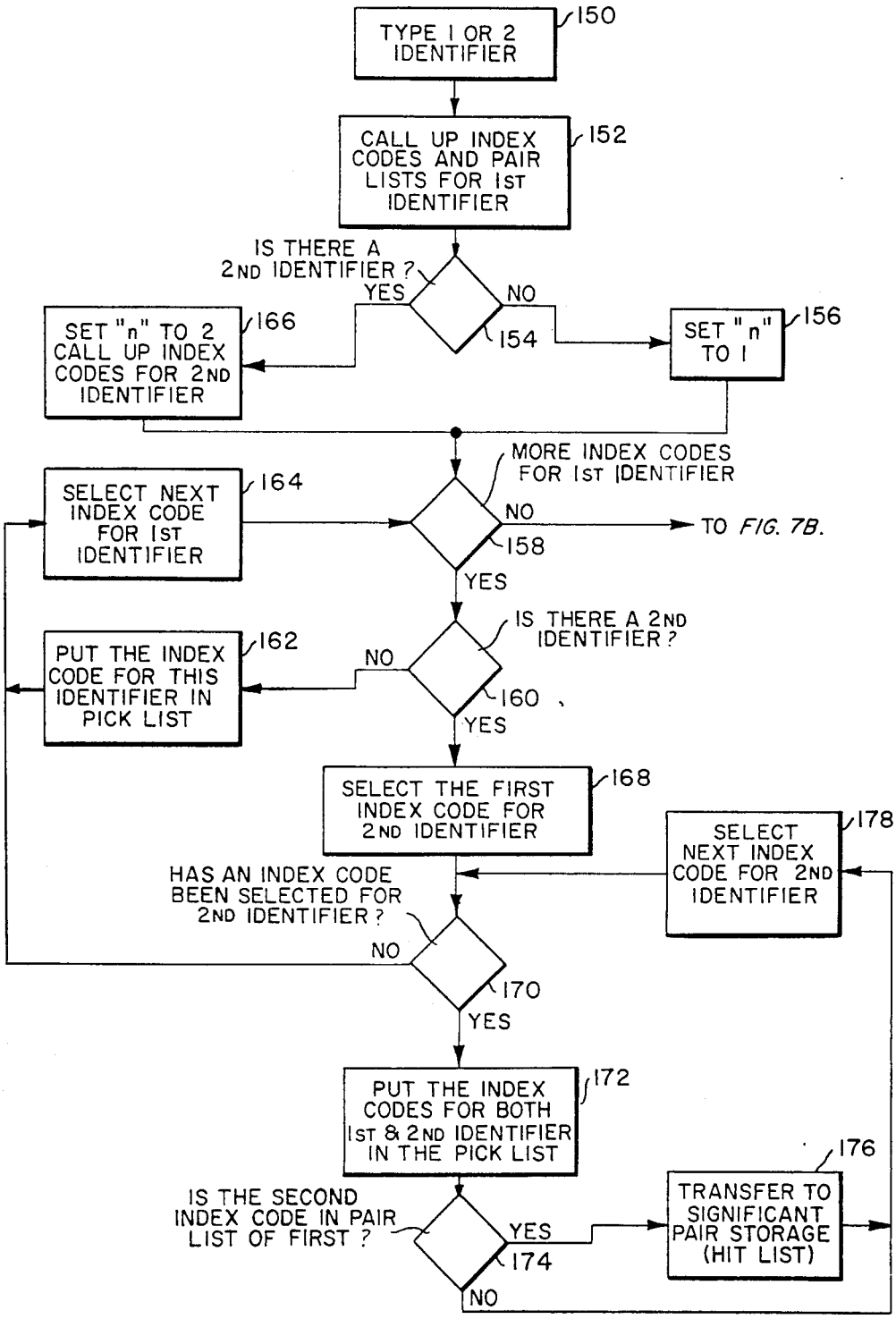
FIGS. 7A, 7B and 7C present a flow diagram of the method of the present invention.
Figure 7B:
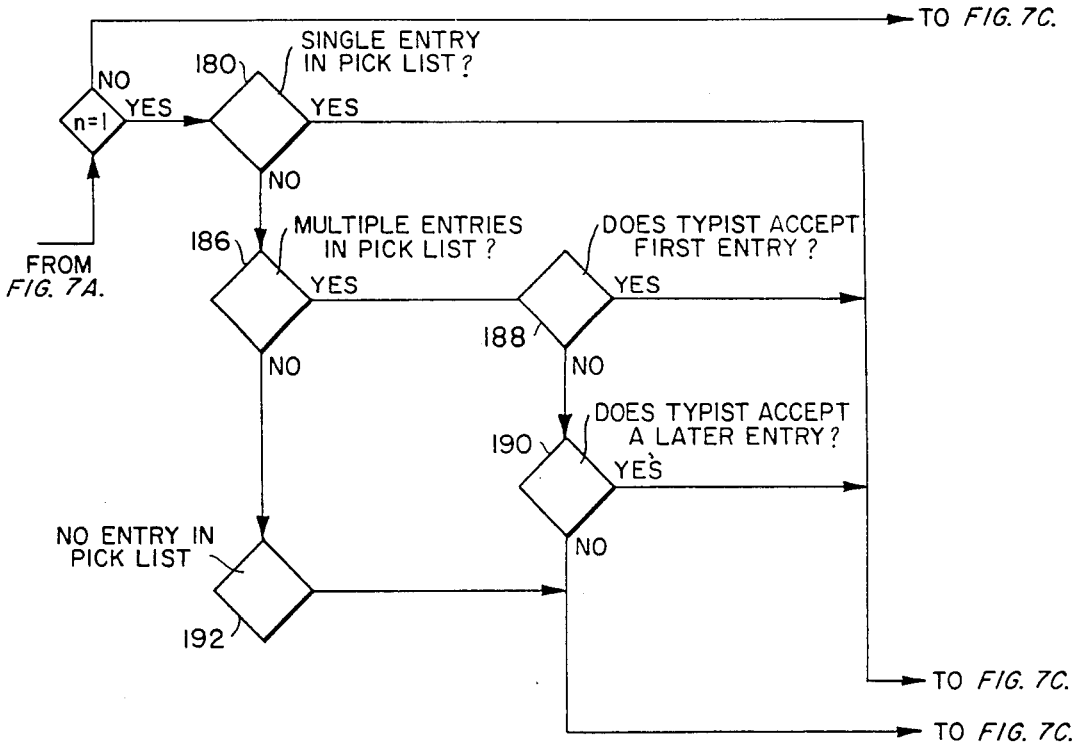
Figure 7C:
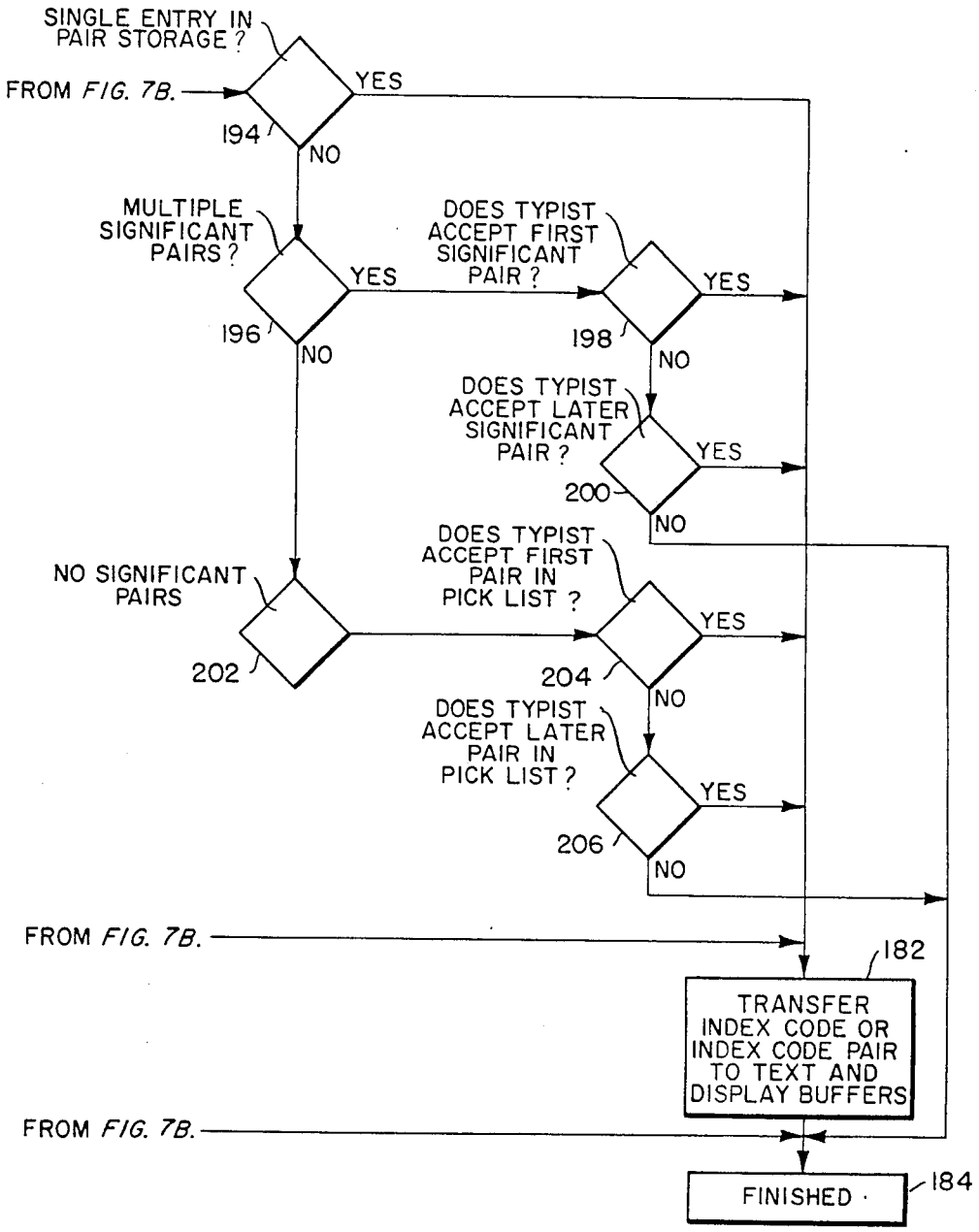

The method of resolving ambiguities in the typing of symbolic graphical characters such as Chinese ideograms by the use of the system described with respect to the preceeding figures is illustrated diagrammatically in FIGS. 7A, 7B and 7C which represent a flow chart for the circuitry of FIGS. 6A and 6B. As indicated in block 150, the first step in the process is for the typist to enter into the system by means of either the keyboard 10 or the keyboard 11 one or two coded identifiers selected in accordance with the four-corner stroke configuration of the character or characters to be typed, or selected in accordance with the phonetic spelling of such character or characters, or selected in accordance with a combination of these, i.e., with some characters being selected phonetically and others by their shape. The two modes are interchangeable, not exclusive, so that if desired each character of a two-syllable word can be selected differently. Upon entry of this information by the typist, the system calls up the index codes and pair lists for the first identifier, as indicated in block 152, and determines whether there is a second identifier, as indicated in block 154. If there is no second identifier, the identifier count is set to one, as indicated in block 156, and the process proceeds with the selection of all of the index codes for the first identifier, as indicated by blocks 158, 160, 162 and 164. If a second identifier code is entered, the system first registers that fact and then calls up the index codes for the second identifier, as indicated in block 166, before proceeding.

When there is a second identifier, the first index code for the first identifier is selected, as indicated in block 158, and the system then selects the first index code for the second identifier, as indicated in block 168, rather than immediately proceeding to select all of the remaining index codes for the first identifier. Upon selection of the first index code for both the first and second identifiers, the pair is transferred to the pick list selection buffer 76 as indicated in block 170 and 172. This process is the function of the matching network 120 of FIG. 6A.

The next step is to compare this pick list entry with each of the pair listings for the first identifier, in accordance with block 174. This is the function of the comparator 122 in FIG. 6A. If the selected pair corresponds with one of the permissible pairs in the pair listing, thereby indicating that this pair might be the one that is desired by the typist, this pair is transferred to the significant pair storage buffer (referred to as the "hit list"), as indicated in block 176. Thereafter, the next index code for the second identifier is selected, as indicated by block 178, it is matched with the first index code for the first identifier, and this new pair is placed in the pick list buffer 76 for comparison with the pair listings, as before, This process continues until all of the index codes for the second identifier have been paired with the first index code for the first identifier.

When as indicated by block 170, no additional index codes are available for the second identifier, the second index code for the first identifier is selected in accordance with block 164 and that second index code is compared with the index codes for the second identifier in accordance with blocks 168, 170, 172, 174, 176 and 178. Thereafter, block 164 selects the next index code for the first identifier and the process is repeated until all of the index codes for the first identifier have been matched with all of the index codes for the second identifier, all of the matched pairs have been compared to the pair listings for the first identifier, and all significant pairs have been stored in the significant pair storage buffer 124.

It will be seen that if only one identifier has been entered into the system ($n=1$), then all of the index codes for the first identifier are entered in the pick list buffer 76. Similarly, if ($n=2$), all of the possible pairs of index codes for the first and second identifiers are entered in the pick list 76 and further, these are compared with the permissible pair listings for the first identifier and any matchups (or hits) are stored in the significant pair storage buffer 124. The system is then ready to proceed to the selection process, which results in the final selection of the desired character or characters in accordance with the procedures of FIG. 7B.

Considering first the situation where only a single identifier has been entered, the first step in the selection process is to scan the pick list buffer 76 to determine whether a single index code has been selected, as indicated by block 180 (FIG. 7B). If so, that index code is transferred to the text and display buffers 92 and 96, in accordance with block 182 (FIG. 7C), for visual inspection by the typist and the process is complete, as indicated by block 184. In this case, the stroke configuration identifier entered by the typist will have correctly identified a single character which is the one desired by the typist, and that character can then be printed or stored, as desired.

If there is not a single selection in the pick list buffer 76, the steps of blocks 186, 188 and 190 are followed. In this case, the first entry in the pick list is selected and displayed for visual inspection by the typist and if the typist accepts that first entry, it is transferred to the text and display buffers 92 and 96 in accordance with block 182. If, however, the first entry is not accepted, the remaining entries are displayed, and if the typist accepts one of these, the accepted entry is transferred to the text and display buffers. Again, if none of the entries are accepted by the typist, there is no transfer of data to the text and display buffers, and the process is completed.

If no entries show up in the pick list 76, indicating that the identifiers failed to call up a corresponding character index code, there is nothing to be displayed and the process is complete, as indicated by block 192.

Where the typist has entered two identifiers, the selection process of FIG. 7C is followed. The first step in this process is indicated by block 194, wherein the significant pair storage buffer (124 in FIG. 6A) is scanned to determine whether there is only a single entry. If so, the matching and comparing procedures carried out by the matching network 120 and the comparator 122 have successfully and automatically resolved any ambiguities in the typing process, and this single entry can then be transferred to the text and display buffers 92 and 96 indicated in block 182, thereby completing the typing of those two characters.

If more than one pair of index codes is found in the pair storage buffer 124, as indicated by block 196, the first pair is selected and presented to the typist for visual inspection, as indicated in block 198. If that first pair is accepted, it is transferred to the text and display buffers 92 and 96 in accordance with block 182. If that first pair is not accepted, however, the remaining pairs from the pair storage buffer are presented for inspection, and if the typist accepts one of those later pairs, as indicated by block 200, the accepted pair is transferred. Again, if the typist does not accept any of these later pairs, the process is complete.

Finally, if inspection of the pair storage buffer 124 reveals no significant pairs stored therein by the comparator process, as indicated in block 202, the system operates to allow the typist to duplicate the process previously carried out by the comparator 122. Thus, in accordance with block 204, the first pair placed in the pick list buffer (76 in FIG. 6A) is selected and the typist determines whether to accept that first pair. If it is accepted, it is transferred to the text and display buffers 92 and 96. If it is not accepted, then in accordance with block 206, each of the following pairs in the pick list 76 are selected in turn and if the typist accepts one of those pairs, it is transferred to the text and display buffers. If none of these pairs is accepted, the character identification process is complete for the selected identifiers.

From the foregoing it will be seen that a new and unique procedure for identifying Chinese or like characters by selected stroke configuration and/or phonetic spelling is provided. Because of the recognition that certain characters appear in pairs, the ambiguities otherwise inherent in the identification process can be eliminated or at least reduced in number so that if a manual selection of characters must be made, the number to be considered is greatly reduced. In this way, typing speed for ideographic characters is greatly enhanced over prior systems.

EXAMPLE 1

The operation of the present system for a single Chinese character having a four digit identifier may be illustrated as follows:

If the word to be enteres is "dì", translated "land", keys 4411 on the keyboard 10 are depressed, since those keys carry shape configurations which most nearly resemble the four quadrant shapes of the character "dì", as shown in FIG. 3.

As illustrated in Table I hereinabove, the conventional Telegraph Code is used in the presently preferred embodiment of the invention as the index code for the specific Chinese characters, with each identifier number serving to call up all characters having the peripheral shape configurations represented by this particular keyboard entry. Thus, the identifier 4411 calls up from the system storage file the characters represented by the index (Telegraph) codes 966 and 5413 (See Table I), plus the pair listings for each, and these are stored in the first identifier storage buffer 62.

Because this example assumes that only a single character identifier is involved, the index codes 966 and 5413, but not the pair listings, are transferred to the "pick list" selection buffer 76, and the character represented by the first index code 966 is displayed. This character is the word "dì" (as established by the Telegraph Code book, for example), which the typist accepts. Accordingly, the typist adds the index code 966 to the text buffer, and goes to the next character to be typed.

EXAMPLE 2

The operation of the system in handling another single identifier representing, for example, the word "fāng", translated "area", may be illustrated as follows:

From FIGS. 2 and 3, it will be seen that the shape identifier code which represents the stroke configuration for "fāng" is 955, only three code numbers being needed since the shape of the character is such that there is no peripheral stroke in the second quadrant. In the present system, it is not necessary to use a filler zero in the identifier, so that source of introduced ambiguity is avoided. As shown in Table II above, the shape identifier code 955 calls up six characters which have similar peripheral configurations (see FIGS. 4*a*–4*f*), which characters are represented by the index codes 5148, 2455, 1593, 794 and 1579, taken from the Telegraph Code book. These index codes, accompanied by their pair listings, are transferred to the buffer 62, and the index codes only are then transferred to the pick list selection buffer 76, since pair listings are not required for single character words.

The fact that six characters have been called up by a single shape identifier represents an ambiguity to be resolved. Disambiguation is accomplished by first displaying the character represented by the index code 5148, which is illustrated in FIG. 4*a*. If this is not the desired character (and it is not in the present example), it is rejected by the typist, and the selector logic then displays the five characters represented by the remaining five index codes in buffer 76. These are the characters of FIGS. 4*b*–4*f*.

If the typist decides that the first of these characters (FIG. 4*b*) is the desired one, the number "1" is indicated by the typist on the keyboard, and when the "print" button is pressed, the index code 2455 is stored in the text buffer 92.

Even though ambiguities are present in both Example 1 and Example 2 which are not automatically resolved, it will be seen that the present system has greatly reduced the number of characters displayed to the typist for manual selection, and the speed with which the desired character can be selected and typed is thereby greatly enhanced.

EXAMPLE 3

The use of the pair listings in the automatic resolution of ambiguities may be illustrated as follows:

The character pair "dì fāng", translated "place" is to be typed, using the system in the shape recognition mode. The typist first inspects the character "dì", and enters the identifier 4411 on the keyboard 10, this coded identifier being selected by inspection and recognition of the peripheral stroke configurations. The typist recognizes that the next character is part of a Chinese two-syllable word, or compound word, so the delimeter "," is then entered by depressing key 12 on the keyboard, and the next character of the two-syllable word is inspected and its corresponding identifier 955 entered by the keyboard. The recognition of a Chinese compound requires that the typist be familiar with the Chinese language.

The index codes 966 and 5413 for the first character, together with their permissible pair listings (i.e., the listing of characters with which the first character may be paired to form a compound) are entered in buffer 62, and since there are two characters, the index codes for the second character, i.e., code numbers 5148, 2455, 1593, 7559, 794 and 1579, are entered into buffer 66. Since these index codes represent the second character of a word-phrase, their pair listings are not required, and thus are not entered in buffer 66.

The matching network then pairs the index codes, to provide the following list of possible pairings:

| | |
|---|---|
| 966 | 5148 |
| 966 | 2455 |
| 966 | 1593 |
| 966 | 7559 |
| 966 | 794 |
| 966 | 1579 |
| 5413 | 5148 |
| 5413 | 2455 |
| 5413 | 1593 |
| 5413 | 7559 |
| 5413 | 794 |
| 5413 | 1579 |

This listing of possible pairings is compared with each of the permissible pairs (See Table I) for the first character stored in the storage buffer 62, and all of the possible pairs which are found in the list of permissible pairings are transferred to the significant pair storage buffer 124. In this case, it will be seen that the pair 966, 2455 is found in both places, and is stored in buffer 124. This is the only pair which appears in both lists.

The selector logic 90 determines that only a single pair is stored in buffer 124, and accordingly displays the characters represented by the index codes 966 and 2455; namely "dì fāng", the desired characters. Thus, all ambiguities have been resolved automatically, and the codes 966 and 2455 are entered in the text buffer 92.

The operation of the system in the phonetic mode, using the pinyin system for identifying the characters to be typed, is essentially the same as in the shape recognition mode illustrated above. The only difference is that instead of using keyboard 10 to enter a shape identifier code, the keyboard 11 is used to enter the phonetic (pinyin) spelling of the character or characters to be typed, and the phonetic spelling provides the required identifier codes. The identifier codes then operate in the same manner as described above to call up all of the corresponding characters, and the index codes of the called-up characters are transferred to buffers 62 and 66. Thereafter, the matching network 120 pairs the index codes, and disambiguation proceeds as described above.

Although keyboards 10 and 11 can be used separately and a system can be produced in accordance with the invention having only one keyboard, numerous advantages may be derived from providing the two in parallel. With such an arrangement, the two keyboards can be interchangeably used without resorting to any sort of shift mechanism, and the system will operate as described above. Thus, for example, the word "dì fāng" can be identified in any of the following ways:

Shape recognition: 4411, 955
Pinyin: dì, fāng
Shape+pinyin: 4411, fāng
Pinyin+shape: dì, 955

In the use of the present system, entry of any one of the above sets of identifiers would result in a display of the characters shown in FIG. 2.

Although the system and method of the invention have been described in terms of block diagram circuitry illustrating the structure and function of data processing circuitry capable of carrying out the concepts of the system, it will be understood that in a preferred embodiment of the invention, the process may be carried out in a general purpose data processer appropriately programmed to follow the procedures described above. An example of a program listing which is capable of carrying out such a procedure in PDP-11/40 general purpose computer is set out in Appendix A. Although this program listing represents the currently used procedure for carrying out the invention, it will be apparent that special purpose circuitry may be constructed in accordance with the foregoing description to carry out the described method equally well. Numerous variations and modifications may be made in the illustrated system and in the program listing, such as adapting the system for use with symbolic languages other than Chinese, or permitting the use of the National Phonetic Alphabet (Zhuyin Fuhao), kana (for identification of kanji) or any of a number of other syllabaries or alphabets. If desired, the illustrated system and program can be revised to provide for the use of an occasional 5-stroke identifier for common, often-used words that would otherwise have to be disambiguated every time they occurred. These and other variations may be made by those of skill in the art, without departing from the true spirit and scope of the invention as set forth in the following claims.

```
C
C Inputs:
C        Terminal input line (accessed via PARSE)
C        Chinese character identifier data base (accessed via READAT)
C
C Outputs:
C        List of telegraph codes of chosen Chinese characters
C                (returned in TCDS)
C        Number of telegraph codes so returned (returned in PNIDN)
C        Error code (0 => success; -1 => failure) (returned as function
C                result)
C
C
         FUNCTION PICK(TCDS, PNIDN)
C
         IMPLICIT INTEGER (A-Z)
         INTEGER PICKS(2, 64), HITS(10), TCDS(1)
         LOGICAL*1 IDENT(22)
C
         COMMON / IOPAR / BFPAR(7, 3), BLIST(3, 4), CHIDN
         COMMON / LEX / LEXPTR, LEXBUF(41), MSGBUF(41), CURSOR(10),
         1    CPHBUF(1024)
         COMMON / BTREE / KEYMAX, KEYMID, KEYBUF, KEYPTR, LEVEL, LBLK(5),
         1    LPTR(5), SBUF(256, 4)
         COMMON / IDATA / DPTR, TCBUF(200)
         COMMON / DISP / NCPL, NLTB, NLAB, NLQB, TBDLEN, TBDSTR, TBDEND,
         1    TBSTRT, ABSTRT, TISTRT, QBSTRT, CSIZE, CSPACE, XPOS(3),
         1    YPOS(3)
         COMMON / EDPAR / TBPTR, TBEND, TBLEN, ABPTR, ABLEN, QBLEN,
         1    TBUF(1024), ABUF(128), QBUF(32), MODE
         COMMON / KDATA / NKDATA, KNEXT(2), KNEXTB, KROOT, KNUM, KNUMD,
         1    KDB(5), KDLM(5), KDLA(5), KTTL(32)
C
         DATA MXIDN / 2 /          ! MAXIMUM NUMBER OF IDENTIFIERS ALLOWED
         DATA MXPICK / 64 /        ! MAXIMUM NUMBER OF AMBIGUITIES ALLOWED
C
C INITIALIZE # OF IDENTIFIERS, DATA POINTER, FUNCTION RESULT



C
         NIDN = 0
         DPTR = 1
         PICK = -1
C
C GET NEXT IDENTIFIER
C
10       CALL PARSE(IDENT, CODE)
C
C             EOL  OK
         GOTO (30, 20), CODE
C
C GOT ONE: ERROR IF TOO MANY.  READ THE DATA FOR THIS IDENTIFIER
C INTO 'TCBUF'.  ERROR IF IDENTIFIER NOT FOUND.
C
20       IF (NIDN .EQ. MXIDN) GOTO 23
         IF (READAT(IDENT) .LT. 0) GOTO 13
         NIDN = NIDN + 1
C
C CHECK FOR FORMAT CONTROL IDENTIFIER
C
         IF (IDENT(1) .EQ. '.') GOTO 200
         GOTO 10
C
C NO MORE IDENTIFIERS: PERFORM DISAMBIGUATION.
C
C INIT CHARACTER POINTER, HIT POINTER, BUFFER END POINTERS, IDENTIFIER
C # 1 DATA POINTER.
C
```

```
30      CPTR = 0
        HPTR = 0
        END1 = TCBUF(1) + 1
        END2 = END1 + TCBUF(END1)
        PTR1 = 8
C
C LOOP TO STEP THROUGH ALL POSSIBLE TC'S FOR FIRST IDENTIFIER.
C
40      IF (PTR1 .GE. END1) GOTO 110
          NWD1 = TCBUF(PTR1)
          PSTRT = PTR1 + 2
          PEND = PTR1 + NWD1 - 1
          TC1 = TCBUF(PTR1 + 1)
          IF (NIDN .GT. 1) GOTO 50
C ONLY 1 IDENTIFIER WAS ENTERED; NO POSSIBLILTY FOR DISAMBIGUATION
C EXISTS: RECORD TC AS A POSSIBILITY.
C
          IF (CPTR .EQ. MXPICK) GOTO 33
          CPTR = CPTR + 1
          PICKS(1, CPTR) = TC1
          GOTO 100
C
C MORE THAN ONE IDENTIFIER WAS ENTERED: RECORD POSSIBLE PAIRS.
C
50        PTR2 = END1 + 7
60        IF (PTR2 .GE. END2) GOTO 100
            NWD2 = TCBUF(PTR2)
            TC2 = TCBUF(PTR2 + 1)
            IF (CPTR .EQ. MXPICK) GOTO 33
            CPTR = CPTR + 1
            PICKS(1, CPTR) = TC1
            PICKS(2, CPTR) = TC2
            IF (PSTRT .GT. PEND) GOTO 90
C
C THIS TC HAS PAIRINGS; DISAMBIGUATION IS POSSIBLE: SEARCH FOR HITS.
C
            DO 70 I = PSTRT, PEND
              IF (TCBUF(I) .EQ. TC2) GOTO 80
70            CONTINUE
            GOTO 90
C
C GOT A HIT: RECORD THE PAIR
C
80          HPTR = HPTR + 1
            HITS(HPTR) = CPTR
90          PTR2 = PTR2 + NWD2
            GOTO 60
C
100       PTR1 = PTR1 + NWD1
          GOTO 40
C
C ARRAY PICKS(2, CPTR) CONTAINS THE TELEGRAPH CODES OF ALL POSSIBLE
C COMBINATIONS OF CHARACTERS CONTAINING THE ONE OR TWO IDENTIFIERS
C ENTERED. ARRAY HITS(HPTR) CONTAINS POINTERS TO THE PAIRS WHICH WERE
C GRAMMATICALLY INDICATED.
C
110     NPOS = CPTR
        NHITS = HPTR
C
C IF EXACTLY ONE POSSIBILITY, THEN DONE.
C
        IF (NPOS .NE. 1) GOTO 120
        NC = 1
        GOTO 160
C
C IF NO HITS:
C
C TRY FIRST POSSIBLITY
C
```

```
120     IF (NHITS .NE. 0) GOTO 140
        NC = QUERY(PICKS, 0, 1, NIDN)
        IF (NC .GT. 0) GOTO 160
C
C THAT'S NOT IT: ELIMINATE IT & TRY THE REST
C
        PICKS(1, 1) = 0
        NC = QUERY(PICKS, 0, NPOS, NIDN)
        IF (NC .LT. 0) GOTO 999
        GOTO 160
C
C GOT A HIT:
C
C DONE IF ONLY ONE
C
140     IF (NHITS .NE. 1) GOTO 150
        NC = HITS(1)
        GOTO 160
C
C TRY FIRST POSSIBLE HIT
C
150     NC = QUERY(PICKS, HITS, 1, NIDN)
        IF (NC .GT. 0) GOTO 160
C
C THAT'S NOT IT: ELIMINATE IT & TRY THE REST
C
        PICKS(1, HITS(1)) = 0
        NC = QUERY(PICKS, HITS, NHITS, NIDN)
        IF (NC .LT. 0) GOTO 999
C
C
C FORMAT CONTROL IDENTIFIER: GET ARGUMENT IF ANY.
C
200     ARG = 1          !DEFAULT = 1
        CALL PARSE(IDENT, CODE)
        GOTO (220, 210), CODE
210     ARG = VAL(IDENT)
        IF ((ARG .AND. "177400) .NE. 0) GOTO 53
C
C ERROR IF NON-UNIQUE TC OR TC OUT OF RANGE.
C
220     IF (TCBUF(1) .NE. 9 .OR. TCBUF(8) .NE. 2) GOTO 43
        TC1 = TCBUF(9) - 10100
        IF ((TC1 .AND. "177700) .NE. 0) GOTO 43
C
C CREATE SPECIAL PSEUDO TC.  FORMAT: 01FFFFFFAAAAAAAA
C WHERE F IS FORMAT CONTROL FUNCTION CODE (TC - 10100)
C AND A IS ARGUMENT.
C
        PICKS(1, 1) = "40000 + TC1 * "400 + ARG
        NC = 1
C
C RETURN THE PROPER TELEGRAPH CODE(S) & NUMBER THEREOF; SET SUCCESS FLAG
C
160     DO 170 I = 1, NIDN
          TCDS(I) = PICKS(I, NC)
170       CONTINUE
        PNIDN = NIDN
        PICK = 0
C
999     RETURN
C
C ERRORS
C
C IDENTIFIER NOT FOUND: BEEP HIM SO THAT HE WILL LOOK UP AND
C SEE THE MESSAGE.
C
13      IF (ITTOUR(7) .LT. 0) GOTO 13
        CALL SCOPY('Identifier not found', MSGBUF)
        GOTO 999
C
23      CALL SCOPY('Too many identifiers', MSGBUF)
        GOTO 999
```

```
C
33      CALL SCOPY('Too many possibilities', MSGBUF)
        GOTO 110
C
43      CALL SCOPY('Bad format control data', MSGBUF)
        GOTO 999
C
53      CALL SCOPY('Format control argument out of range', MSGBUF)
        GOTO 999
C
        END
```

What is claimed is:

1. A method of producing ideographic text material utilizing a keyboard having a plurality of keys, each key carrying a single indicium corresponding to a predetermined characteristic stroke configuration found in a graphic character to be produced, comprising:

storing in a memory a plurality of graphic characters having stroke configurations similar to those of characters to be produced, each stored character having an identifier code based on the stroke configuration of that character;

selecting one or more keys to construct for a desired character an identifier code corresponding to its characteristic stroke configurations, the step of selecting one or more keys for each desired character including selecting, for each quadrant of a graphic character wherein a characteristic stroke configuration appears, the single key carrying the indicium which most closely identifies the shape of that stroke configuration, the selection of between one and four single keys in sequence combining to produce a constructed identifier code for the desired character;

calling up from said memory all stored characters having identifier codes identical to the constructed identifier code for said desired character;

temporarily storing said called-up characters;

determining whether an ambiguity exists between the number of characters desired and the number of characters called up by said constructed identifier code and placed in temporary storage;

automatically directing the called-up character to a text storage means if no ambiguity exists; and resolving any ambiguities caused by a difference between the number of characters desired and the number of characters called up to select a desired called-up character, and thereafter directing the desired called-up character to the text storage means.

2. A method of producing ideographic text material utilizing a keyboard having a plurality of keys each representing an indicium corresponding to graphic characters to be produced, comprising:

selecting one or more keys in sequence to produce a first identifier for a first desired character;

selecting one or more keys in sequence to produce a second identifier for a second desired character of a compound word;

calling up from a character memory all the characters which correspond to said first identifier;

calling up from said character memory a permissible pair list for each character corresponding to said first identifier;

calling up from said character memory all the characters which correspond to said second identifier;

matching each of the characters corresponding to said first identifier with each of the characters corresponding to said second identifier to produce a list of possible character pairs; determining whether an ambiguity exists between said possible pair list and said permissible pair list; and resolving any ambiguity.

3. The method of claim 2 wherein the step of determining whether an ambiguity exists comprises comparing said permissible pair list with said possible pair list to determine whether more than one character pair appears in both of said lists.

4. The method of claim 3, wherein the step of determing whether an ambiguity exists further comprises manually selecting a desired character pair when more than one pair appears in both of said lists.

5. A method of typing symbolic language text material utilizing a keyboard having indicia corresponding to configurations typical of graphic characters used in such symbolic language, comprising:

selecting up to four keyboard indicia approximating actual stroke configurations appearing sequentially around the peripheral quadrants of a character to be typed to produce a shape identifier code for the character;

calling up from a character memory all characters which correspond to the shape identifier code produced by said keyboard, and which have peripheral stroke configurations similar to or the same as, and in the same sequence as, the character to be typed;

storing in a selection buffer the characters called up by the identifier code;

transferring to a text storage means the character stored in the selection buffer when there is no ambiguity in the selection buffer;

resolving ambiguities which exist in the selection of the desired character, when multiple characters are called up from the character memory and stored in said selection buffer, by transferring to a display buffer one after another the characters stored in said selection buffer to determine in each instance if it is the desired character to be typed;

selecting from the displayed characters a desired character; and transferring the selected character to the text storage means.

6. The method of claim 5 wherein the step of selecting from the displayed characters a desired character includes manually producing by the use of the keyboard an indicator for the desired character, whereby the indicated character is transferred to the text storage means.

7. The method of claim 6, further including the step of printing the character stored in said text storage means to produce the symbolic language text selected by a typist.

8. The method of claim 7, wherein the symbolic language is Chinese.

9. The method of claim 7, wherein the step of selecting keyboard indicia includes selecting, for each quadrant of a graphic character where a characteristic stroke configuration appears, the single indicium which most closely identifies that stroke configuration, between one and four single indicia combining to provide the identifier code for the character.

10. A method of typing symbolic language text material utilizing a keyboard having a plurality of keys corresponding to a like number of stroke configurations typically used at the extremities of ideogrammatic language characters, comprising:

selecting up to four keyboard indicia corresponding to stroke configurations appearing at the periphery of a first character of a compound word to be typed to produce a first identifier for the word;

selecting up to four keyboard indicia corresponding to stroke configuration appearing at the periphery of a second character of said compound word to produce a second identifier for the word;

calling up from a character memory all the characters which correspond to said first identifier;

calling up from said character memory a permissible pair listing for each character corresponding to said first identifier;

storing said characters corresponding to said first identifier and said pair listings therefor in a first storage buffer;

calling up from said character memory all the characters which correspond to said second identifier;

storing said characters corresponding to said second identifier in a second storage buffer;

matching each of said characters in said first storage buffer with each of said characters in said second storage buffer to produce a list of possible character pairs;

storing said list of possible character pairs in a selection buffer;

comparing each of said possible pairs from said selection buffer with each of the permissible pairs listed in said first storage buffer;

storing in a significant pair storage means all pairs which are found in both said possible pair list and said permissible pair list;

determining the number of character pairs stored in said significant pair storage means to determine whether an ambiguity exists; and resolving any ambiguities by manually selecting one of the pairs in said significant pair storage means.

11. The method of claim 10, further including transferring the character pair in said significant pair storage means directly to a text buffer means when no ambiguity exists in said significant pair storage means, whereby the desired compound word is automatically typed.

12. The method of claim 11, wherein the step of resolving any ambiguities includes:

transferring to a display buffer a first character pair stored in said significant pair storage means to determine if it is the character pair to be typed;

thereafter transferring to the display buffer in sequence the remaining character pairs stored in said significant pair storage means;

selecting from the displayed character pairs a desired character pair; and transferring the selected character pair to a text storage means.

13. The method of claim 12 wherein the step of selecting a desired character pair from the displayed character pairs includes manually producing by use of the keyboard an indicator for the desired character pair.

14. The method of claim 13, further including the step of printing the character pair stored in said text storage means to produce the symbolic language text material selected by the typist.

15. The method of claim 13, wherein the step of selecting, for each quadrant of each ideogrammatic character to be typed in which a characteristic stroke configuration appears, the single keyboard indicium which most closely identifies that stroke configuration, whereby between one and four indicia are combined to provide the identifier for each character.

16. The method of claim 15, wherein the symbolic language is Chinese.

17. An electronic system for identifying and resolving ambiguities in the selection of single character or two-character symbolic language words, comprising:

a keyboard having a plurality of key indicia corresponding to selected features of graphic characters and adapted to produce an identifier representing a character to be typed;

file means containing a first list of characters and a second list of permitted character pairings, said characters and pairings being listed in said file by index codes selectable by specified identifiers, whereby a selected identifier will call up the index codes and pairings of all characters having that identifier;

first storage means for receiving the index codes and permitted pairings for the identifier of a first character to be typed;

second storage means for receiving the index codes for the identifier of a second character in a two-character word to be typed;

a matching network for matching the index codes stored in said first storage means with the index codes in said second storage means to produce a list of possible character pairs for a two-character word;

selection storage means;

means for connecting said selection storage means either to said first storage means to receive and store only the index codes in said first storage means for a single character or to said matching network to receive said list of possible pairs for a two-character word;

a comparator connected to said selection storage means for comparing said list of permitted character pairings with said list of possible pairs;

significant pair storage means to receive and store character pairs appearing in both said list of permitted pairings and said list of possible pairs; and selector means connected either to said selection storage means to resolve single character ambiguities or to said significant pair storage means to resolve two-character word ambiguities.

18. The apparatus of claim 17, further including means responsive to the number of characters in a symbolic language word to control the connection between said first and second storage means, said matching network, and said selection storage means.

19. The apparatus of claim 17, wherein said selection means includes means to selectively display the symbolic language characters corresponding to index codes stored in said selection storage means; and text file means to receive and store the single character word to be typed.

20. The apparatus of claim 17, wherein said selector means includes:

means to selectively display the graphic characters corresponding to the index code pairs stored in said significant pair storage means; and text file means to receive and store the character pair representing the two-character word to be typed.

21. The apparatus of claim 19, wherein said graphic characters are ideographic characters.

22. The apparatus of claim 20, wherein said graphic characters are Chinese language characters.

23. The apparatus of claim 17, wherein said selected features of graphic characters are peripheral stroke configurations thereof.

24. The apparatus of claim 17, wherein said selected features of graphic characters are the phonetic spellings of said characters.

25. An electronic system for typing symbolic language text material through identification of selected features thereof, wherein different graphic characters for said language may have similar identifying features, comprising:

first storage means for receiving and storing a graphic character list and a permitted character pairing list for each graphic character, each said graphic character having an index code selectable by at least one specified identifier code;

manually operable selector means corresponding to selected identifying features of graphic characters, said selector means being operable to produce an identifier code representing identified features of the character to be typed;

means responsive to each said identifier code to call up the index codes and corresponding pairing lists of all graphic characters having the specified identifier code;

means for displaying the graphic character or characters selected by said identifier code; and means for resolving ambiguities in the selection of said characters, whereby only the desired character or characters to be typed remains.

26. The system of claim 25, wherein said manually operable selector means comprises a keyboard wherein each key carries a different graphic stroke configuration approximating actual stroke configurations appearing at the periphery of graphic characters to be typed.

27. The system of claim 25, wherein said identifying features are shape identifiers approximating peripheral stroke configurations of the character to by typed.

28. The system of claim 25, wherein said identifying features are the phonetic English language equivalent of the character to by typed.

29. The system of claim 28, wherein said manually operable selector means comprises a keyboard having keys carrying alphabetical indicia for producing an identifier code corresponding to the phonetic spelling of the character to be typed.

30. The system of claim 25, wherein symbolic language incorporates single words represented by two characters, said system further including:

second storage means for receiving and storing the index codes and corresponding pairings list for first character of said two-character word; and third storage means for receiving and storing the index codes of said second character of said two-character word, wherein said means for resolving ambiguities comprises matching means for comparing said index codes in said third storage means with said pairings list in said second storage means to produce a list of possible character pairs for a two-character word having the identifying features selected by said selector means, and wherein said display means displays said list of possible character pairs.

31. A method of typing symbolic language text material through identification of selected features thereof, wherein different graphic characters for said language may have similar identifying features, comprising:

storing a graphic character list and a permitted character pairing list for each graphic character to be used in said text material, each said graphic character having an index code selectable by at least one specified identifier code;

generating a first identifier code corresponding to selected identifying features of a first graphic character;

calling up from said first storage means all graphic characters and permitted pairing lists which correspond to said first identifier code;

generating a second identifier code corresponding to selected identifying features of a second graphic character when a second character is combined with said first character in said symbolic language to form a compound;

calling up from said first storage means all graphic characters which correspond to said second identifier code; and disambiguating said called-up characters to identify the character or compound to be typed.

32. The method of claim 31, wherein the steps.of generating identifier codes comprises selecting, by means of a keyboard, indicia corresponding to the phonetic spelling of a character to be typed.

33. The method of claim 32, wherein said symbolic language is Chinese, and wherein said phonetic spelling comprises pinyin.

34. The method of claim 31, wherein the steps of generating identifier codes comprises selecting, by means of a keyboard, indicia corresponding to graphic stroke configurations at the periphery of a character to be typed.

35. The method of claim 34, wherein said keyboard-selected indicia comprise shape identifiers typifying actual stroke configurations found at the periphery of graphic characters to be typed.

36. The method of claim 31, wherein the steps of generating identifier codes comprise selecting, by means of a keyboard, first indicia corresponding to graphic stroke configurations at the periphery of a character to be typed or second indicia corresponding to the phonetic spelling of a character to be typed.

37. The method of claim 31, wherein the step of disambiguating said called-up characters comprises, for a single-character word in said symbolic language, sequentially displaying said called-up characters in a predetermined order, and selecting from said displayed characters the character to be typed.

38. The method of claim 37, wherein the step of disambiguating said called-up characters comprises, for a compound word in said symbolic language, matching each of said called-up characters corresponding to said first identifier code with each of said called-up characters corresponding to said second identifier code to produce a list of possible character pairs; and comparing each of said possible character pairs with said permitted pairing lists to identify significant character pairs which appear on both said possible character pairs list and said permitted pairing lists.

39. The method of claim 38, wherein the step of disambiguating said called-up characters further comprises displaying said significant character pairs and selecting one of said significant pairs.

* * * * *